United States Patent [19]

Weigl

[11] 4,243,246

[45] Jan. 6, 1981

[54] SAFETY BINDING FOR SKIING BOOTS

[75] Inventor: Erwin Weigl, Brunn a.Gebirge, Austria

[73] Assignee: Polyair Produkt Design GmbH, Kittsee, Austria

[21] Appl. No.: 958,821

[22] Filed: Nov. 8, 1978

[30] Foreign Application Priority Data

Nov. 11, 1977 [AT] Austria ..... 8076/77

[51] Int. Cl.[3] ..... A63C 9/08

[52] U.S. Cl. ..... 280/628

[58] Field of Search ..... 280/623, 618, 626, 628

[56] References Cited

U.S. PATENT DOCUMENTS 3,326,567 6/1967 Pronzati ..... 280/628

FOREIGN PATENT DOCUMENTS 2304929 8/1974 Fed. Rep. of Germany ..... 280/628
2119230 7/1972 France ..... 280/628
453989 6/1968 Switzerland ..... 280/628

*Primary Examiner*—John J. Love

*Assistant Examiner*—Michael Mar

*Attorney, Agent, or Firm*—Scully, Scott, Murphy & Presser

[57] ABSTRACT

A safety binding for skiing boots, including a toe holder, a heel holder, a spring-loaded locking member, which is mounted to be displaceable in the direction of its longitudinal axis against a spring force and has a convexly curved head which cooperates with a concavely curved surface of a keeper. The keeper is connected to the heel holder and is pivotally movable relative to the longitudinal axis of the locking member, wherein the concavely curved surface of the keeper has different radii of curvature in a vertical plane and in a horizontal plane and the heel holder is pivoted on a horizontal axis and on a vertical axis. The horizontal and vertical pivotal axes of the heel holder cross each other and are spaced different distances from the forward edge of the heel holder exceeding the smallest distance from the point of contact between the head of the locking member and the keeper to the forward edge, which faces the toe holder or the boot.

7 Claims, 7 Drawing Figures

SAFETY BINDING FOR SKIING BOOTS

Figure 3:
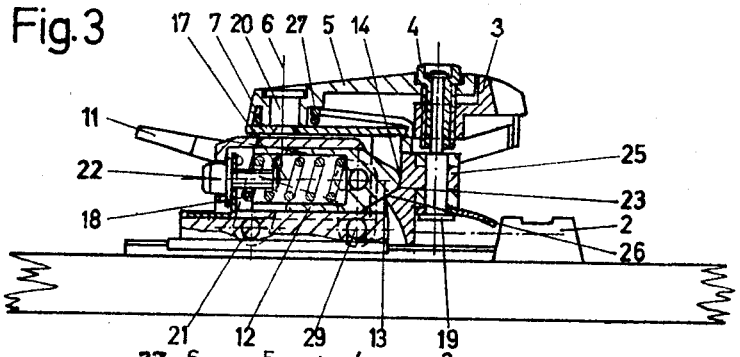

This invention relates to a safety binding for skiing boots, comprising a toe holder, a heel holder, and a spring-loaded locking member, which is mounted to be displaceable in the direction of its longitudinal axis against a spring force and has a convexly curved head which cooperates with a concavely curved surface of a keeper, which is connected to the heel holder and pivotally movable relative to the longitudinal axis of the locking member, wherein the concavely curved surface of the keeper has different radii of curvature in a vertical plane and in a horizontal plane and the heel holder is pivoted on a horizontal axis and on a vertical axis. Such safety bindings are used in conjunction with sole plates or may comprise jaws which cooperate with the sole of the skiing boot. The known safety bindings of this kind comprise locking members having a head which is symmetrically curved with respect to the longitudinal axis of the locking member so that the head of such known locking member has the shape of a frustum of a cone and a crowned apex. In position for use, that crowned apex engages the concavely curved surface of the pivoted keeper and there is, as a rule, only a point contact between the apex of the head of the locking member and the concavely curved surface of the keeper. During skiing, when the safety binding has not released, that apex will perform only small movements relative to the point in contact with the concavely curved surface. This point contact results in the course of time in an increasing wear of the contacted portion of the concavely curved surface and a recess may form in the latter. Such recess in the concavely curved surface will increase the forces required for a release of the ski binding so that the ski binding will not release under the action of the preset force when there has been a substantial wear.

It is an object of the invention to provide a safety binding in which the pressure exerted by the locking member on the concavely curved surface of the pivoted keeper is minimized.

It is another object of the invention to increase the reliability of the binding in use because the wear is decreased, and also to provide a simplified structure which permits of meeting different requirements regarding the release characteristics which govern the release in response to a vertical and horizontal deflection of the heel holder. In that connection it is desired to ensure that strong restoring forces are exerted in response to small deflections so that an undesired release of the safety binding is avoided.

To accomplish that object, a safety binding of the kind defined first hereinbefore is characterized according to the invention in that the horizontal and vertical pivotal axes of the heel holder cross each other and are spaced different distances from the forward edge of the heel holder, exceeding the smallest distance from the point of contact between the head of the locking member and the keeper to said forward edge, which faces the toe holder or the boot. Because the heel holder is pivoted on two separate pivotal axes, the forces tending to effect a vertical and a horizontal release are exerted on the spring-loaded locking member via the camming surface with different leverages so that different release characteristics for the vertical and horizontal release of the heel holder can be obtained although only a single spring is provided. The design according to the invention also permits of upwardly inclined release movements governed by a desired release characteristic. Because in a top plan view the two pivotal axes of the heel holder when fixed to the ski are disposed behind the point of contact between the locking member and the camming surface, the spring force acting on the spring-loaded locking member and, as a result, the pressure applied, can be considerably decreased so that the wear is decreased, too.

In a preferred embodiment of the safety binding according to the invention the distance from the horizontal pivotal axis of the heel holder to the forward edge of the heel holder exceeds the distance from the vertical axis of the heel holder to said forward edge, which faces the toe holder or the boot. In such an arrangement, small horizontal pivotal movements result in relatively strong restoring forces so that the functional reliability of the binding is much increased and, above all, an unintended release of the binding is avoided. Because the heel holder is pivoted on two different axes, there is a virtually universal joint. As the lever arms for a horizontal and for a vertical release of the heel holder differ in length, that universal joint can be designed in a particularly simple manner for the required release characteristic.

To further decrease the wear and thus to increase the functional reliability, the arrangement is preferably such that the head of the bolt is crowned to conform to the concavely curved surface of the keeper. As a result, the pressure force applied by the locking member is distributed on a maximum area so that the maximum pressure is decreased.

The arrangement may be such that the radii of curvature of the convex surface of the head of the locking member in a vertical plane and in a horizontal plane have a ratio of about 1:2.5, and an intermediate portion of the head of the locking member preferably has a larger radius of curvature and is substantially flat in the horizontal plane. As a result, the wear of the concavely curved camming surface is decreased so that the preset force required for a release of the safety binding will be maintained constant for a long time.

Because the curvature of the head of the locking member conforms to the curvature of the concavely curved surface in a larger area than is possible in the case of a point contact, the wear of the contacting portion, which in accordance with the invention consists of a surface, in position of use is much decreased and the release of the binding as a result of a lateral pivotal movement of the retaining member requires smaller components of force than a release caused by an upward pivotal movement of the keeper about a transverse pivotal axis which is parallel to the ski. On the other hand, such strictly horizontal or vertical pivotal movements of the keeper do not occur in the case of a fall. The safety binding may release in response to all possible combinations of these two pivotal movements. In the binding according to the invention, at least a line contact will be maintained during any conceivable pivotal movement of the keeper relative to the longitudinal axis of the locking member. As a result, a formation of grooves and recesses in the concavely curved surface of the keeper is avoided and the preset forces required for a release of the binding will be maintained constant for a long time. The design which has been described ensures at least in position of use a surface contact between the head of the locking member and the concavely curved surface so that the wear is minimized.

In accordance with the invention the design may be such that the member formed with the concavely curved surface is detachably connected to the heel holder. In that case the member formed with the concavely curved surface can easily be removed and a different release characteristic can be selected in a simple manner. Because the binding according to the invention exhibits only a small wear, the member formed with the concavely curved surface, which is detachably connected to the heel-holding jaw member, may be made of plastic material, preferably of an acetal resin, such a Delrin produced by DuPont. Alternatively, the concavely curved surface may be lined with plastic material, preferably polytetrafluoroethylene (Teflon).

Figure 4:
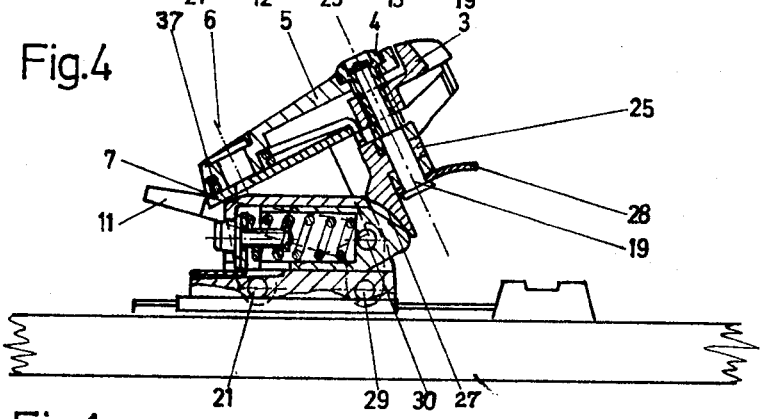
Figure 1:
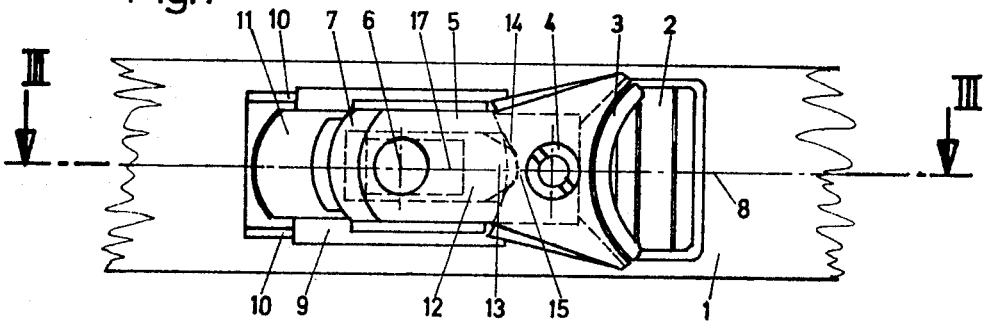
Figure 2:
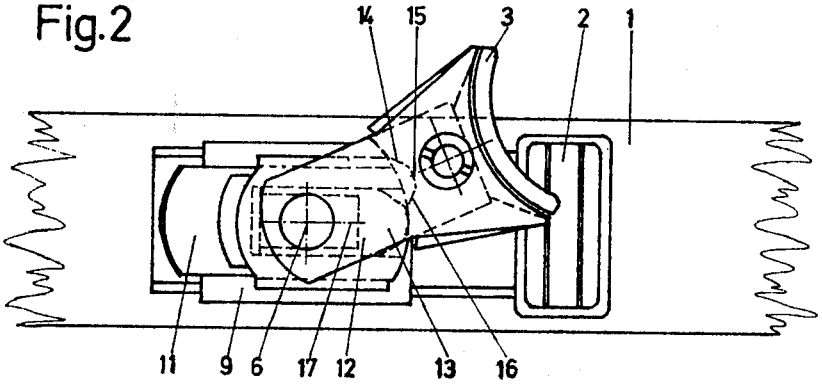
Figure 7:
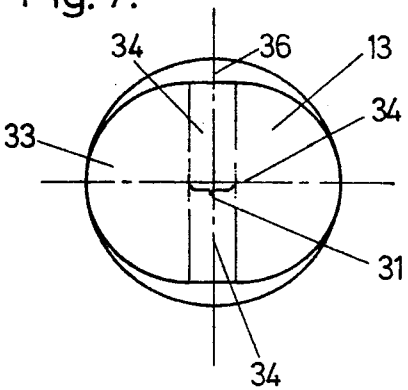
Figure 5:
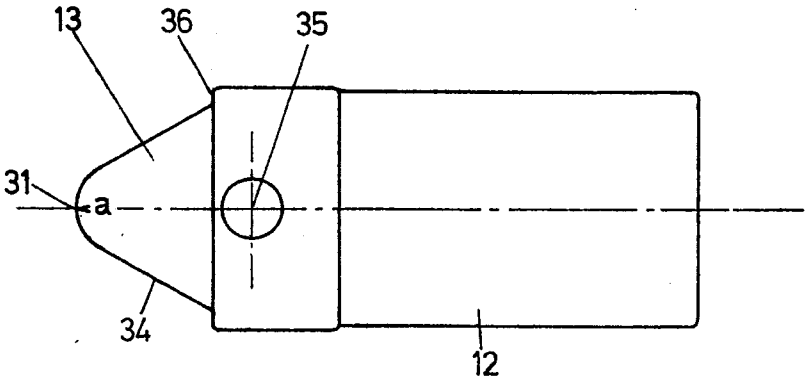
Figure 6:
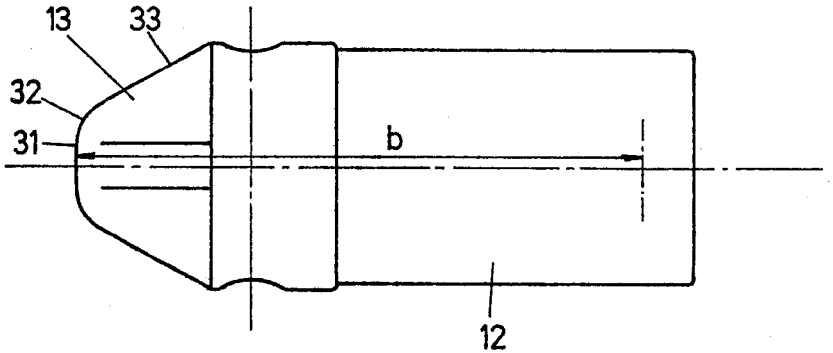

Further details of the invention will become apparent from the following description of an illustrative embodiment which is shown on the drawings, in which FIG. 1 is a top plan view showing the heel holder in position for use, FIG. 2 is a top plan view showing the heel holder of FIG. 1 in a released position, FIG. 3 is a transverse sectional view taken on line III—III in FIG. 1, FIG. 4 is a sectional view that is similar to FIG. 3 and shows the heel holder during a vertical release, FIG. 5 is a side elevation showing the locking member, FIG. 6 is a top plan view showing the locking member, and FIG. 7 is a front elevation showing the head of the locking member.

FIG. 1 is a top plan view showing a ski 1, to which a plate 2 for supporting the heel of a skiing boot is secured. A jaw member 3 cooperating with the upper edge of the sole of a skiing boot or another portion of the skiing boot adjacent to the heel thereof is secured by a nut 4 to a member 5, which is pivotally movable in horizontal and vertical direction. The member 5 is pivotally movable in a horizontal direction about a pivotal axis 6, which is at right angles to the surface of the ski 1 (FIG. 2). The pivot which defines the pivotal axis 6 is carried by a member 7, which is pivoted on an axis that is parallel to the surface of the ski 1 and transverse to the longitudinal axis 8. This enables an upward pivotal movement of the jaw-carrying member 5 to the position shown in FIG. 4. The movable parts of the heel holder assembly are pivoted to a frame 9, which is movable in the longitudinal direction 8 of the ski 1 and for this purpose is slidably mounted on guides 10, which are secured to the surface of the ski. The frame 9 can be fixed in position on the guides 10. An actuating lever 11 is operable to open the binding when the skier desires to step into or out of the binding.

In FIGS. 1 and 2, the spring-loaded locking member 12 is shown in dotted lines in FIGS. 1 and 2, from which the shape of the concavely curved surface 14 is apparent. The head 13 of the locking member cooperates with a concavely curved surface 14. The shape of that portion of said concavely curved surface which controls the release of the binding in a horizontal direction is apparent from FIGS. 1 and 2. The concavely curved surface 14 has a curved intermediate portion 15, which gradually merges into approximately flat marginal portions 16. In FIGS. 1 and 2, dotted lines indicate the sectional shape of the concave surface 14 in a horizontal plane which contains the longitudinal axis 17 of the spring-loaded locking member 12 and is parallel to the surface of the ski.

FIG. 2 is provided with the same reference characters as FIG. 1 and shows the binding in a released position, which has resulted from a horizontal pivotal movement of the jaw member 3.

FIG. 3 shows the spring 18, which loads the locking member 12. The sectional view of FIG. 3 is taken on the vertical plane which contains the longitudinal axis 17 of the locking member 12. The jaw member 3 is connected to the member 5 by a bolt 19 and the nut 4. The member 5 is pivoted to a member 7 by a pin 20, which defines the axis 6 shown in FIG. 1. The member 5 is pivotally movable about the axis 6 in a substantially horizontal direction. The member 7 is pivoted on the axis 21, which is parallel to the surface of the ski and transverse to the longitudinal axis 8 of the ski. The distance from the horizontal pivotal axis 21 to the forward edge of the heel holder 3 exceeds the distance from the vertical pivotal axis 6 to said forward edge, which faces the boot. The distances from the pivotal axes 6 and 21 to the forward edge of the heel holder 3 exceed the smallest distance from the head 13 of the locking member to said forward edge. The pivotal movement about the axis 21 causes the jaw mamber 3 of the heel holder to assume the raised position shown in FIG. 4. The spring force applied to the locking member 12 can be adjusted by an adjusting screw 22. In position of use, the head 13 of the locking member 12 cooperates with the curved surface 14. From the sectional view of FIG. 3 the curvature of the concavely curved surface 14 in its portion 23 is apparent, which is disposed below the horizontal plane which in position of use contains the axis 17. By a comparison of FIGS. 1 and 3 it is found that the portion 23 has a smaller radius of curvature than the intermediate portion 15 in the horizontal plane which in position of use contains the longitudinal axis of the locking member 12. That portion of the curved surface 14 which adjoins the portion 23 above that horizontal plane may have any desired shape because it is not significant for the release characteristic of the safety binding. The concavely curved surface 14 is provided on a member 25 which is secured to the member 5 and the jaw member 3 by the bolt 19 and the nut 4. To open the safety binding, the head 13 of the locking member 12 must be displaced in the direction of its longitudinal axis 17 against the force of the spring 18. During this movement the head 13 of the locking member 12 moves along the cam formed by the concavely curved surface 14. When in case of a fall the ski binding releases in response to an upward pivotal movement of the member 7 about the axis 21, the head 13 of the locking member 12 will slide over the portion 23 of the concavely curved surface 14 so that the spring is compressed. As soon as the spring 18 has been compressed to such an extent that the head 13 of the spring-loaded locking member 12 clears the innermost portion 26 of the concavely curved surface 14, the binding will be completely released and will assume the open position shown in FIG. 4. That portion 27 of the component 25 which adjoins the portion 23 of the concavely curved surface 14 is concave and assists a further pivotal movement of the member 7 about the axis 21. During its horizontal pivotal movement of the component 5 relative to the member 7 about the axis 6, the member 5 overcomes the force of the spring 37.

An extension 28 which is directed away from the spring-loaded locking member 12 is also connected by the bolt 19 and nut 4 to the jaw member 3, the member 25 formed with the three-dimensional cam, i.e. the concavely curved surface 14, and the member 5. When the skier steps into the binding, the sole of the skiing boot will depress the extension 28 so that the spring-loaded locking member 12 overcomes the force of the spring 18 and is moved to its locking position, in which the head 13 engages the concavely curved surface 14 at the portion 23 thereof. When the skier desires to step out of the binding, he can actuate the lever 11, which is angled and is pivoted to the frame 9 on the axis 29. The angled lever 11 is provided with projections 30, which cooperate with the head 13 of the spring-loaded locking member 12. As the angled lever 11 is depressed, it is pivotally moved about the axis 29 and takes along the locking member 12 rearwardly in the direction of its axis 17 while overcoming the force of the spring 18. As a result, the binding is released to open.

In FIGS. 5 to 7, the locking member 12 is shown on a larger scale in FIG. 5 in a side elevation and in FIG. 6 in a top plan view. In side elevation the head 13 of the locking member has such a curvature that it conforms to the portion 23 of the concavely curved surface 14. The radius a of that curvature in side elevation is distinctly smaller than the radius b of curvature of the intermediate portion 31 of the head 13 in a top plan view. The intermediate portion 31 of the head 13 merges via a small portion 32, which has a smaller radius of curvature in a top plan view, into flat marginal portions 33. In a side elevation the flat marginal portions 34 directly adjoin the intermediate portion 31. At 35, the locking member 12 is engageable by the angled lever 11 when it is desired to open the binding arbitrarily.

The head 13 is shown in front elevation in FIG. 7, from which the wider intermediate portion 31 as well as the marginal portions 33 and 34 adjoining the portion 31 are apparent. In a top plan view, a shoulder 36 is seen, which is disposed between the marginal portions 34 and the body of the locking member 12. That shoulder should not collide with portions of the concavely curved surface 14. For this reason the shoulder 36 is recessed to such an extent that even during a pivotal movement of the heel holder about the axis 21, as shown in FIG. 4, the shoulder 36 can contact only the rearmost portion 26 of the concavely curved surface 14.

In the horizontal plane which contains the axis 17 of the locking member 12, the intermediate portion 15, shown in FIGS. 1 and 2, of the concavely curved surface 14 has a radius of curvature which equals the radius of curvature b of the portion 31. In position of use, the concavely curved surface 14 has in its portion 23 disposed below that horizontal plane a radius of curvature which is equal to the radius of curvature a of the intermediate portion 31. As a result, the head 13 of the locking member 12 is in surface contact with the concavely curved surface in position of use, shown in FIGS. 1 and 3.

What I claim is:

1. A safety binding for skiing boots, comprising a toe holder, a heel holder, a spring-loaded locking member, which is mounted to be displaceable in the direction of its longitudinal axis against a spring force and has a convexly curved head which cooperates with a concavely curved surface of a keeper, which is connected to the heel holder and is pivotally movable relative to the longitudinal axis of the locking member, wherein the concavely curved surface of the keeper has different radii of curvature in a vertical plane and in a horizontal plane and the heel holder is pivoted on a horizontal axis and on a vertical axis, characterized in that the head of the locking member is crowned to conform to the concavely curved surface and has an intermediate portion which in a horizontal plane has a larger radius of curvature and is substantially flat, and that the keeper formed with the concavely curved surface is detachably connected to the heel holder, and that the horizontal and vertical pivotal axes of the heel holder cross each other and are spaced different distances from the forward edge of the heel holder, exceeding the smallest distance from the point of contact between the head of the locking member and the keeper to said forward edge which faces the toe holder or the boot, and the distance from the horizontal pivotal axis of the heel holder to the forward edge of the heel holder exceeds the distance from the vertical axis of the heel holder to said forward edge which faces the toe holder or the boot.

2. A safety binding according to claim 1, characterized in that said horizontal pivotal axis of the heel holder is positioned relatively low on the binding closely adjacent to the top surface of the ski, below the vertical position of the convexly curved head of said locking member, to prevent the release forces of the binding from being increased as the binding is opened.

3. A safety binding according to claim 1 or 2, characterized in that said vertical pivotal axis of the heel holder is defined by a vertical pivoting pin which is positioned relatively high on the binding, above the vertical position of the convexly curved head of said locking member, to provide a compact, dirt-resistant design.

4. A safety binding according to claim 1, including a return spring to assist in resetting the binding after release.

5. A safety ski binding according to claim 1, characterized in that the radii of curvature of the convex head of the locking member in a vertical plane and in a horizontal plane have a ratio of about 1:2.5.

6. A safety binding according to claim 1, characterized in that the member which is formed with the concavely curved surface and detachably connected to the jaw member of the heel holder consists of plastic material, preferably acetal resin.

7. A safety binding according to claim 1, characterized in that the concavely curved surface is lined with plastic material, preferably polytetrafluoroethylene.

* * * * *